United States Patent [19]

Foster

[11] 4,346,288

[45] Aug. 24, 1982

[54] FUEL SAVING AIRCRAFT DESCENT CALCULATOR

[76] Inventor: Edward T. Foster, 1653 Berwick Pl., Westlake Village, Calif. 91361

[21] Appl. No.: 202,601

[22] Filed: Oct. 31, 1980

[51] Int. Cl.[3] ..... G06G 1/02; G06C 3/00

[52] U.S. Cl. ..... 235/70 A; 235/78 N; 235/88 N

[58] Field of Search ..... 235/61 NV, 61 FA, 70 R, 235/70 A, 78 N, 88 N, 89 R

[56] References Cited

U.S. PATENT DOCUMENTS

| | | | |
|---|---|---|---|
| 2,433,984 | 1/1948 | De Vries | 235/78 N |
| 3,220,644 | 11/1965 | Gaudio | 235/78 N |
| 3,279,695 | 10/1966 | Krause | 235/78 N |
| 3,360,195 | 12/1967 | Fisher | 235/78 N |
| 3,693,872 | 9/1972 | Titus | 235/78 N |
| 3,825,180 | 7/1974 | Gallagher | 235/78 N |
| 3,835,299 | 9/1974 | Turney | 235/61 NV |
| 3,929,279 | 12/1975 | Dibley | 235/88 N |
| 4,011,987 | 3/1977 | Cheek | 235/88 N |

*Primary Examiner*—L. T. Hix
*Assistant Examiner*—Benjamin R. Fuller
*Attorney, Agent, or Firm*—Richard S. Koppel

[57] ABSTRACT

A manually operable calculator for optimizing aircraft fuel consumption during descent from an actual altitude to a target altitude/distance. Altitude and distance scales are provided which are alignable to determine an uncorrected fuel efficient distance to commence a descent from a given altitude to a target location, with separate scales being provided for different airspeeds. Wind and weight correction scales are also provided which give a distance correction based upon the aircraft's weight, prevailing wind conditions, and the difference between beginning and target altitudes. In the preferred embodiment a plurality of altitude scales are employed, each scale having thereon an altitude display which is proportioned in accordance with a respective air speed and given in terms of mach speed for altitudes above a mach speed/I.A.S. transition point, and in terms of I.A.S. below that point. In this embodiment a single, linear distance scale is employed.

14 Claims, 6 Drawing Figures

FIG. 1.
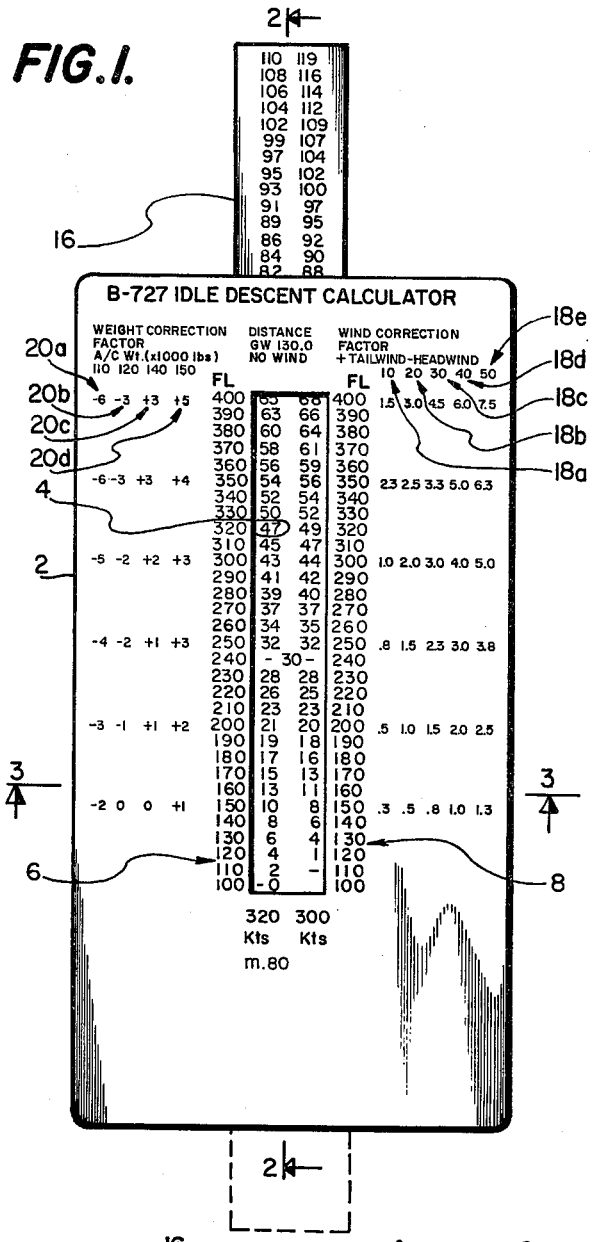
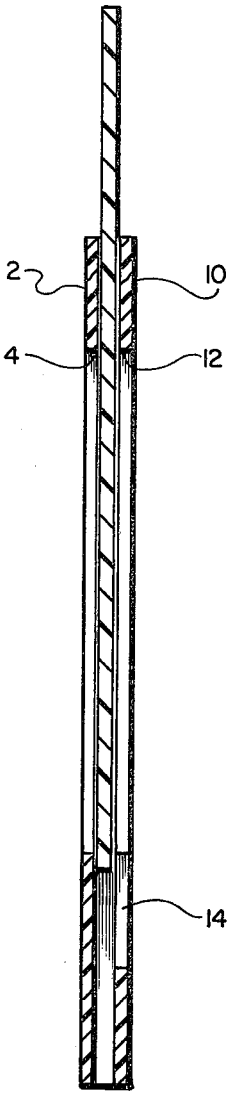
FIG. 2.
FIG. 3.

FUEL SAVING AIRCRAFT DESCENT CALCULATOR

BACKGROUND OF THE INVENTION

1. Field of the Invention

This invention relates to aircraft navigation equipment, and more particularly to a manually operable descent calculator for determining the optimal fuel efficient point at which to commence a descent.

2. Description of the Prior Art

Significant fuel ecomonies can be achieved when an aircraft follows a proper descent profile from cruise altitude on approach to landing. Conversely, excess and unnecessary amounts of fuel will be expended if the aircraft begins its descent either too soon or too late. Typically, the pilot will be instructed to descend from a cruise altitude of perhaps 35,000 feet to a target altitude of perhaps 13,000 feet, at a specified distance from the runway. If the pilot begins to descend at too great a distance from the airport, the descent will be unnecessarily shallow and result in greater fuel consumption than on an optimum descent. On the other hand, if the pilot doesn't begin the descent until after the optimal point has been passed, the descent will be too steep for minimum fuel consumption, and again fuel will be wasted.

Calculations have been performed in the past to determine the optimal descent profile in terms of fuel economy for a given aircraft speed, altitude, target altitude, and target distance from the runway. The problem is to present this information to the pilot in a useable format under actual flight conditions, in which the pilot's attention may be diverted by many other factors when beginning a descent to land. Any instrument for informing the pilot when to begin a descent should be sufficiently flexible to adapt to different aircraft parameters such as speed and altitude, easy and quick to operate, and display a clear result. While a digital computer could be programed to provide the desired descent profile information, such equipment is fairly expensive and would occupy valuable space in the aircraft console.

One prior art attempt to provide a pilot with useable information on when to begin a descent is disclosed in U.S. Pat. No. 4,011,987, issued Mar. 15, 1977 to Frank L. Cheek. The patent discloses an aircraft descent profile calculator with three members defining outer, intermediate and inner annular dial faces. The intermediate dial face has aircraft altitude indicia displayed on it which increase in prescribed altitude increments in a first direction around the intermediate dial face. The inner and outer dial faces have aircraft DME (Distance Measuring Equipment station) distance displays which increase in prescribed distance increments in opposite directions around the dial faces. Approaching DME distance indicia are recorded on the outer disk member, while leaving DME distance indicia are recorded on the inner disk member. The relationship between the altitude indicia in adjacent spaces on the intermediate disk member compared to the DME distance indicia on the inner and outer disk members is selected to provide a known descent profile. A DME distance for beginning a descent from an aircraft's actual altitude to a target altitude and DME distance is obtained by aligning the target altitude on the intermediate disk with the target distance on either the inner or outer disk and comparing the actual altitude with the corresponding distance on the inner or outer disk.

The Cheek patent is based on a fixed ratio linear descent profile of 1000 feet altitude loss per 3 or 4 nautical miles, depending upon the rate of descent selected. This, however, is only an approximation of actual descent performance; the optimal ratio for greatest fuel economy varies substantially with air speed, wind and aircraft weight difference. The Cheek patent is subject to improvement because it does not provide for the above factors.

Another aircraft flight path calculator is disclosed in U.S. Pat. No. 3,929,279, issued Dec. 30, 1975 to Dibley. In this device an inner dial is divided into DME distance increments, while an outer dial has two altitude scales, one for the altitude range from 10,000 through 40,000 feet, and the other from ground zero through 10,000 feet. The two altitude scales have different proportions, corresponding to different air speeds above and below 10,000 feet. The upper altitude scale is also extended down to ground zero to accommodate the possibility of an approach without a deceleration interval. Around the periphery of the outer element are displayed two different scales relating rate of descent to actual ground speed, one scale corresponding to a descent gradient of 400 feet per mile at a ground speed of 340 knots, and the other scale corresponding to a descent gradient of 300 feet per mile at a ground speed of 250 knots. While the patent specification is not explicit concerning the detailed operation of the calculator, the pilot apparently aligns the target distance with the target altitude, and then refers to his actual altitude to obtain distance for commencing a descent. The pilot then apparently refers to the descent rate/ground speed scales to determine the rate of descent he should follow. While the latter scales introduce aircraft weight and wind speed as factors in the descent profile to be followed, in the sense that weight and wind will effect ground speed and thus the rate of descent the pilot is to follow, the initial point at which the aircraft begins to descend does not change to correspond to differing weight and wind conditions. This in turn leads to greater than necessary fuel consumption, since for optimal fuel consumption of the aircraft should begin to descend at a greater distance for tailwinds or heavy loadings, and at a lesser distance for headwinds or light loadings. Furthermore, the Dibley patent does not provide for a change of speed other than at 10,000 feet altitude, nor does it take into account the fact that aircraft speed is normally given as mach speed above roughly 30,000 feet, and as indicated air speed below roughly 30,000 feet. In addition, the Dibley device assumes the use of power management to provide a descent rate, which is a more difficult procedure than an idle descent.

Thus, there is still a need for an aircraft descent calculator which is capable of taking into account and adjusting to different conditions or aircraft weight, wind, aircraft speed and altitude, and without unduly complicating the device.

SUMMARY OF THE INVENTION

In view of the above problems found in the prior art, it is an object of the present invention to provide a novel and improved aircraft descent calculator which takes both aircraft weight and outside wind conditions into account in calculating a descent profile to maximize fuel savings.

Another object of the invention is the provision of a novel and improved aircraft descent calculator which provides a fuel effecient descent profile including changes in aircraft speed during the descent.

In the accomplishment of these and other objects of the invention, a manually operable calculator for optimizing aircraft fuel consumption during descent from an actual altitude and distance to a target altitude and distance is provided with a first member having a distance scale displayed thereon, and at least one additional member having an altitude scale displayed thereon. The first and additional members are mutually secured and alignable, and their respective distance and altitude scales are proportioned such that, when a target distance on the distance scale is aligned with a target altitude on the altitude scale, the actual altitude on the altitude scale is aligned with a desired fuel efficient distance for commencing the descent, for a given aircraft weight and speed and a given wind condition. In addition, an aircraft weight and wind correction scale is provided, by which a correction factor can be obtained to correct the indicated distance for commencing the descent. The correction scale preferrably comprises a first portion for determining a gross correction factor corresponding to a maximum altitude, and a second scale portion which proportions the gross correction factor in accordance with the actual aircraft altitude.

In the preferred embodiment, a plurality of altitude scales are provided on a corresponding plurality of members which are secured for relative aligned movement with the distance scale member. Each altitude scale is proportioned to correspond with a respective aircraft speed, thereby enabling the calculator to give accurate results for different descent speeds, and for descents involving decelerations or accelerations in speed.

Additional calculator accuracy is achieved by proportioning the altitude scales for each aircraft speed in terms of mach speed above predetermined transition altitudes, and in terms of indicated air speed below the transition altitudes. The transition altitude for each aircraft speed is equal to that altitude above which mach speed exceeds indicated air speed, and below which indicated air speed exceeds mach speed. The descent gradient (or altitude loss/mileage ratio) for any particular idle descent varies at different altitude ranges, primarily because of the mach-indicated air speed crossover, and to a lesser degree because of changes in air density and true air speed as altitude changes. Accuracy in this regard is achieved in the present invention by making a single distance scale linear and a plurality of the altitude scales variable to reflect accurately the proper altitude/mileage ratio for a particular altitude segment and aircraft speed. Furthermore, the various altitude scales extend over approximately equal altitude ranges.

These and other features and advantages of the invention will be apparent to one skilled in the art from the following detailed specification, taken together with the accompanying drawings, in which:

DESCRIPTION OF THE DRAWINGS

FIG. 1 is a plan view of a calculator constructed in accordance with the invention, in a linear slide rule type format;

FIGS. 2 and 3 are cross-sectional views taken along the lines 2—2 and 3—3 of FIG. 1 respectively;

DETAILED DESCRIPTION OF PREFERRED EMBODIMENTS

Figure 4:
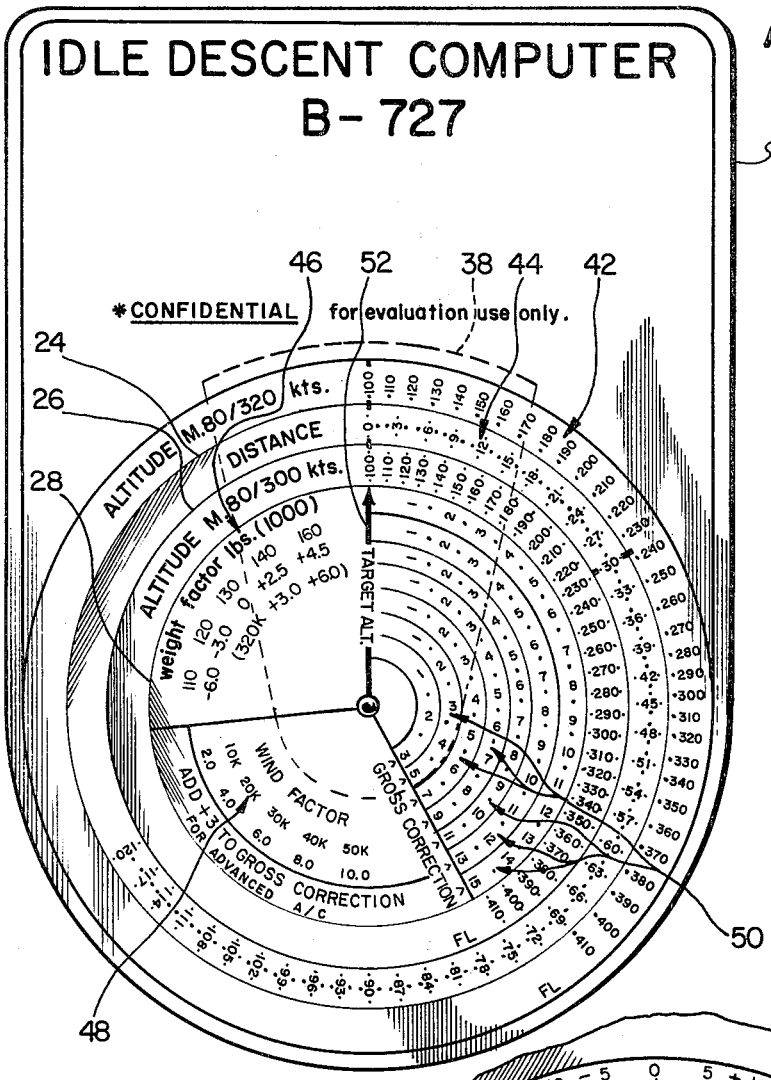
FIGS. 4 and 5 are respectively plan and side views of another embodiment of the calculator constructed in a circular slide rule format.

Referring to FIGS. 1–3, a first embodiment of the invention in the form of a linear slide rule-type calculator is shown. A first, generally rectangular card 2 formed from a durable plastic or cardboard has a longitudinal slot 4 cut out of its central portion. Equally proportioned altitude scales 6 and 8 are displayed along opposite longitudinal sides of the slot, each scale progressing linearly from 10,000 feet altitude at the bottom to 40,000 feet altitude at the top. A similar card 10 is secured back-to-back with card 2 by inserts 11, the two cards being adhered together on lateral sides of slot 4. Card 10 is provided with a central longitudinal slot 12 which registers with slot 4, one side of slot 12 extending in a downward leg 14 below the lower limit of slot 4.

A slideable stick 16 with DME distance indicia displayed thereon is lodged between cards 2 and 10 in alignment with slots 4 and 12. The calculator also incorporates the four descent speeds most commonly assigned in current commercial flights. The side of stick 16 facing card 2 has two parallel distance scales, one corresponding to an aircraft speed of 320 knots and the other to an aircraft speed of 300 knots. Similar scales are displayed on the opposite side of the stick facing card 10, with one distance scale on the opposite side corresponding to 280 knots, and the other distance scale corresponding to 250 knots. Lower leg 14 or slot 12 is aligned with the 250 knot distance scale to extend the altitude scale for the low speed down to 3,000 feet.

The various distance scales are proportioned in relation to the altitude scales so that the optimum distance for commencing a descent form a given altitude can be easily calculated. For example, assume that the aircraft is flying at an indicated air speed of 300 knots and is to descend from a cruise altitude of 35,000 feet to cross a target point at 30 miles DME distance and 13,000 feet altitude. Stick 16 is moved so that a distance of 30 miles on the 300 knot scale is aligned with an altitude of 13,000 feet on the right hand altitude scale. Going up the altitude scale to 35,000 feet, the aircraft's cruise altitude, the corresponding aligned DME distance is given on the distance scale as 83 miles. This is the distance at which the aircraft should commence its descent for the most fuel efficient approach.

The above calculation was made on the assumption of an aircraft gross weight of 130,000 pounds (for a Boeing 727), with no outside wind. However, the presence of either a headwind or a tailwind will alter the optimal distance for beginning a descent, as will deviations from the nominal 130,000 pound aircraft weight. Thus, if the aircraft were to begin its descent at a distance of 83 miles as indicated above, the presence of wind and/or weight deviation would actually result in fuel being wasted.

The wind and weight variables are conveniently taken into account in the present invention by providing correction scales in alignment with the altitude scales. A wind correction scale is provided on the right hand side of card 2, divided into five columns 18A, 18B, 18C, 18D and 18E corresponding to tail or headwinds of 10, 20, 30, 40 and 50 knots respectively. A gross wind correction factor corresponding to the maximum 40,000 foot altitude is displayed at the top of each column in alignment with 40,000 feet on the altitude scale 8. Each column is proportioned between the 40,000 foot altitude and the lower part of the altitude scale to take into account the progressively reduced effect of wind on the computed distance at lower altitudes. To determine the wind correction factor for a given altitude, the pilot merely refers to the wind correction factor adjacent the given altitude on the altitude scale, and under the column corresponding to the prevailing wind conditions, interpolating as necessary. A tailwind is assigned a positive correction factor, and a headwind a negative correction factor.

Aircraft weight correction factors are provided in a similar manner on the left hand side of card 2 adjacent left hand altitude scale 6. Four correction columns 20A, 20B, 20C and 20D, corresponding respectively to gross aircraft weights of 110-, 120-, 140- and 150,000 pounds for a Boeing 727 aircraft are displayed. The figures in the 110- and 120,000 pound columns are assigned negative values, since a lower gross aircraft weight will permit a closer approach before beginning a descent, while the figures under the 140- and 150,000 pound columns are assigned positive values. Each of the columns extends from the top towards the bottom of the altitude scale, and progressively decrease in value towards the bottom of the scale in correspondence with the decreasing effect of weight on descent distance at the lower altitudes. The weight correction factor is determined in a manner similar to the wind correction factor by merely locating the correction factor in the column corresponding to the actual aircraft weight adjacent the aircraft's altitude.

An overall correction factor is determined by merely aggregating the wind and weight correction factors. For example, assuming an aircraft with a gross weight of 110,000 pounds is flying with a 20 knot tailwind at an altitude of 35,000 feet, the weight correction factor would be minus 6, while the wind correction factor would be plus 2.5, for a net correction factor of minus 3.5. A more precise distance for commencing a descent, and corresponding greater fuel savings, is calculated by subtracting 3.5 from the mileage otherwise indicated by the calculator for beginning the descent.

The calculator is also very useful in monitoring the aircraft's adherence to a fuel efficient descent profile once the descent had begun. The pilot keeps stick 16 in place with the target altitude aligned with the target distance, and reads the calculated distance corresponding to any given altitude during the descent. This calculated distance is corrected by a net wind and weight correction factor for the particular altitude, to tell the pilot whether he is at the correct distance for the given altitude.

The calculator is particularly useful for descents which involve a deceleration from one speed to a lower speed. The pilot would use the altitude and distance of the deceleration point as his first target, and use the calculator to determine the distance for beginning a high speed descent to that point along the distance corresponding to the higher speed. When that point is reached, the pilot can reset the calculator so that the ultimate target distance on the lower speed distance scale is aligned with the ultimate target altitude, and read the distance corresponding to the present altitude. A wind/weight correction factor would then be determined as described above.

Extra distance necessary to decelerate can also be accounted for. In the example described above, assuming the aircraft was required to be slowed to 250 knots at 13,000 feet and 30 miles DME from an initial speed of 280 knots, and that a deceleration distance of two miles was required, the target altitude of 13,000 feet would be aligned with 32 miles on the 280 knot distance scale, rather than 30 miles.

Figure 5:
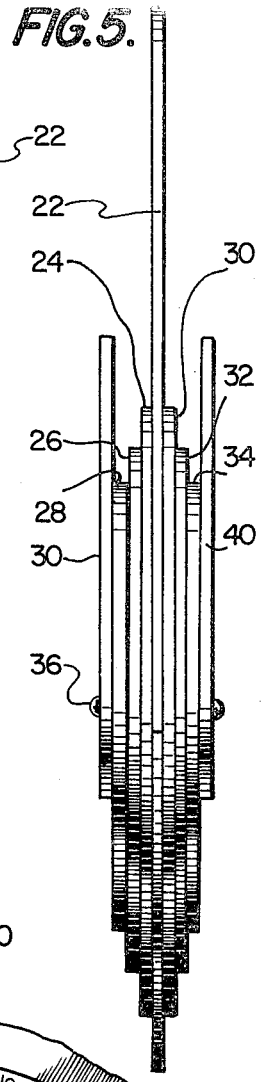
Figure 6:
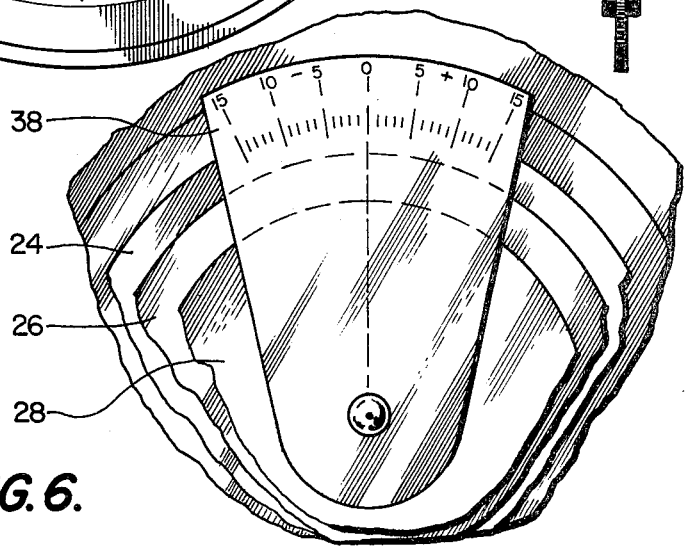
FIG. 6 is a sectional view showing a courser device used in conjunction with the calculator shown in FIGS. 4 and 5.

Referring now to FIGS. 4 and 5, a second embodiment of the invention is shown which offers several advantages over that described above. In this embodiment the calculator is in the general form of a circular slide rule mounted on a center card member 22. A plurality of circular disk members 24, 26 and 28 of progressively decreasing diameter are stack mounted on one side of card 22, and a similar plurality of disk members 30, 32 and 34 of progressively decreasing diameter are stack mounted on the opposite side of card 22. A pin 36 extending through card 22 and the centers of the various disks secures the disks to the card, whereby each of the disks can be rotated relative to the card and to the other disks. A pair of cursor elements 38 and 40 are also secured over the outermost disks on each side of the card to assist in reading the information provided by the calculator.

In contrast to the embodiment described above in conjunction with FIGS. 1–3, in which all of the altitude scales are proportioned identically but different distance scales are provided for each aircraft speed, the embodiment of FIGS. 4 and 5 employs only a single distance scale and a plurality of individually proportioned altitude scales, each altitude scale corresponding to a particular speed. This arrangement has been found to make possible a more accurate calculation of the proper distance for beginning a descent, where the aircraft is initially flying at a mach-based speed, but is to descend to an altitude at which speed is given in terms of indicated air speed.

A brief explanation of the difference between mach and indicated air speed will be helpful in understanding this advantage. The speed of sound, which varies with altitude, is defined at mach 1. Thus, a speed of mach 0.80 at a given altitude is eight-tenths the speed of sound at that altitude. Indicated air speed (I.A.S.), on the other hand is determined by the pressure of ambient air against a moving object. Since the density of the atmosphere progressively decreases at higher altitudes, the air pressure resisting an aircraft moving at the same ground speed will decrease at the higher altitudes, and the I.A.S. will also decrease at those altitudes. I.A.S. is not to be confused with true air speed (T.A.S.), which is the aircraft's ground speed corrected for wind. I.A.S. is equal to T.A.S. at sea level (assuming no wind), but at higher altitudes becomes progressively less than T.A.S.

Mach speed is the controlling parameter at the higher altitudes at which most large commercial aircraft operate. As a subsonic aircraft approaches the speed of sound, it encounters a phenomenon termed "compressability" which is a compression of air molecules ahead of the aircraft. As the speed of sound is approached, radical aerodynamic effects occur. Drag increases dramatically, control becomes unreliable, and buffeting occurs which indicates an impending high speed stall. As the speed of sound is reached, energy is released in the form of a shock wave, the common sonic boom. M 0.80, or 80 percent of the speed of sound, is a typical cruise and descent air speed at the higher altitudes. At this speed the "compressability" effect is relatively minor, but it increases rapidly at higher speeds.

As indicated above, both the speed of sound and I.A.S. vary with altitude, but at different rates. For any given air speed, a transition altitude exists above which mach speed is greater than I.A.S., and below which I.A.S. is greater than mach speed. Commercial aircraft normally operate based on mach speed above this transition point, and on I.A.S. below. However, the precise transition point is different for each different air speed. For example, the transition altitude (the altitude at which mach 0.80 speed equals I.A.S.) for an indicated air speed of 320 knots is about 27,500 feet, for 300 knots it is about 30,000 and for 280 knots the transition point is about 32,500. In accordance with the improved embodiment of FIGS. 4 and 5, a separate altitude scale is provided for each different aircraft speed, each altitude scale being proportioned in terms of mach speed above the transition altitude for that speed, and in terms of I.A.S. below the transition altitude. Only a single, linear distance scale is used on each side of the calculator, although for greatest accuracy the distance scale on the 280/250 knot side is modified slightly from the distance scale on the 320/300 knot side.

Referring now to FIG. 4, such an altitude scale for a speed of M 0.80/320 knots I.A.S. is displayed in a circular format on the face of card 22 around the periphery of the innermost disk 24, and is indicated by reference numeral 42. A linearly proportioned distance scale 44 is displayed on the periphery of disk 24 between disk 26 and card 22, while a second altitude scale proportioned to correspond with an air speed of M 0.80/300 knots I.A.S. is displayed along the periphery of disk 26 visible around disk 28.

Wind and weight correction factors are displayed on disk 28. Gross weight correction factors corresponding to maximum altitude are provided in section 46 of the disk, and gross wind correction factors for maximum altitude in section 48. In order to proportion the gross correction factor for the aircraft's operating altitude, concentric rings 50 are displayed along the remaining portion of disk 28. Each ring, beginning from the innermost and progressing towards the outermost ring, displays progressively greater gross correction factors at one end which is aligned with maximum altitude on the altitude scales, and proportionately decreases the correction factor around the ring towards the lower altitude end of the altitude scales. Cursor 38 is provided to assist in reading the computed distance when the various disks are properly aligned, and has a correction factor display to assist in applying the computed or "net" correction factor. Cursor 38 is preferably formed from a transparent plastic material.

The opposite side of the calculator with disks 30, 32 and 34 is constructed in substantially the same manner with a similar linear distance scale on disk 30. The altitude scales on card 22 and disk 32 are proportioned for M 0.80/280 knot I.A.S. and 250 knot I.A.S. air speeds, respectively (at 250 knots I.A.S. the mach-I.A.S. crossover occurs at an altitude above the upper 41,000 foot limit of the altitude scales, and this is not reflected on the calculator).

As an example of the operation of this embodiment of the invention, assume that an aircraft is flying at a cruise altitude of 35,000 feet at M 0.80 against a 30 knot headwind, and with a gross weight of 115,000 pounds. An M 0.80/300 knots I.A.S. descent is planned, to cross 30 miles DME at 13,000 feet.

To calculate the optimal DME distance for commencing the descent, 13,000 feet on the M 0.80/300 knot altitude display is aligned with 30 miles on the distance display. With this setting, a DME mileage of 83 miles is aligned with an altitude of 35,000 feet; this is the uncorrected distance for beginning a descent. In order to apply wind and weight correction factors, the gross correction scales are entered to derive a weight correction factor of minus 4.5 (by interpolation between the correction factors for 110,000 and 120,000 pounds), and a gross wind correction of minus 6.0 (negative because of the headwind). The total gross correction factor is thus minus 10.5. To establish the actual distance correction, the arrow 52 marking the lower limit of the correction ring is aligned with the target altitude of 13,000 feet on the M 0.80/300 knot altitude disk. With this arrangement the actual altitude of 35,000 feet is seen to be aligned with a net correction factor of about minus 7.75, by interpolating between the correction factors displayed on the 9 and 11 gross correction factor rings. Rounding the net correction factor off to minus 8, a DME distance of 75 miles (83−8) is determined to be the most fuel efficient point to begin the descent.

The hairline of the cursor 38 is an aid in aligning altitude, distance and computed net correction factors. Further, the index "−15, −10, −5, 0, +5, +10, +15" at the outer edge of the cursor provides a convenient guide in applying net correction to uncorrected distances.

The calculator is now set to provide a schedule for descent. At any mileage/altitude during the descent, the aircraft's progress relative to the desired descent can be checked at a glance by viewing the uncorrected distance corresponding to the current altitude in the descent, obtaining a new net correction factor for that altitude from the same 9 and 11 gross correction factor rings, and adding the two to obtain the proper mileage. As in the previous example, an adjustment to the target mileage can be made to accommodate the distance necessary to decelerate.

Operation of the calculator is identical for any of the air speed choices available. The gross correction factors are identical for both air speeds on each side of the computer, but for even greater accuracy the correction factors on one side of the calculator can differ from those on the other side in accordance with their respective speeds. Thus, the calculator can be "programmed" for four airspeeds simultaneously. This can be very helpful and result in considerable fuel savings under present Air Traffic Control conditions in which the pilot may be required to change air speeds, often several times, during a descent. This is potentially very wasteful of fuel, but use of the calculator enables fuel consumption to be minimized. Because the pilot is given optimum air speed/altitude/distance information at any point on the descent profile for four different air speeds, the transition to a different air speed/altitude/distance profile can be made economically. For example, for an aircraft on a 280 knot descent profile, a sudden request to speed up to 320 knots might cause the pilot to lower the nose to gain speed, with the result of the aircraft reaching lower altitude restrictions at an early point, and wasteful applications of power at the lower altitudes being required. If, on the other hand, the pilot has a calculator available and refers to the proper mileage/altitude for 320 knots, an orderly transition can be made to the 320 knot profile by an application of power to shallow the glide angle at a higher altitude, and then reducing power again to idle when the 320 knot profile is intercepted. By thus making the transition to a higher air speed descent at a higher altitude, a more fuel efficient total descent is achieved. In the opposite situation of initially descending at a higher air speed and being requested to slow to a lower air speed, the calculator again provides an orderly program to do so. The pilot would apply the speed brake to slow and steepen the angle of descent until the shallower low speed descent profile is intercepted, and then follow that profile.

The present invention thus provides an accurate and easy to use tool for a pilot to determine and follow a fuel efficient descent profile. While numerous variations and modifications to the embodiments described above may occur to those skilled in the art, it is intended that the invention be limited only in terms of the appended claims.

I claim:

1. A manually operable calculator for calculating a beginning of descent position to optimize aircraft fuel consumption during descent from an actual altitude and distance to a target altitude and distance, comprising:

a first member having a distance scale displayed thereon, a second member having a first altitude scale displayed thereon, said first altitude scale being proportional in terms of indicated air speed below a predetermined altitude, said first and second members being mutually alignable and said distance and first altitude scales being proportioned so that, when a target distance on the distance scale is aligned with a target altitude on the first altitude scale, the actual altitude on the first altitude scale is aligned with a desired fuel efficient distance on the distance scale for commencing the descent, for a given aircraft weight and speed and a given wind condition, an aircraft weight and wind correction scale means, said correction scale means providing a correction factor to adjust the indicated distance for commencing a descent based upon the aircraft weight and prevailing wind conditions, and means mutually securing said first and second members for relative aligned movement.

2. The calculator of claim 1, said correction scale means including means for determining a gross correction factor, and a correction scale display proportioning the gross correction factor in accordance with the actual aircraft altitude to be lost during the descent.

3. The calculator of claim 2, further comprising means having a second altitude scale displayed thereon, said second altitude scale being proportioned in terms of indicated air speed below a predetermined altitude, said first and second altitude scales being proportioned to correspond respectively to first and second aircraft speeds, said distance and second altitude scales being mutually alignable and proportioned so that, when a target distance on the distance scale is aligned with a target altitude on the second altitude scale, the actual altitude on the second altitude scale is aligned with a desired fuel efficient distance on the distance scale for commencing a descent to the target altitude and distance, for a given aircraft weight and speed and a given wind condition.

4. The calculator of claim 3, said second altitude scale being displayed on a third member which is mutually secured and alignable with said first member.

5. The calculator of claim 4, said correction scale being displayed on a fourth member which is mutually secured to said second and third members, said correction scale being alignable with either one of said first and second altitude scales.

6. The calculator of claim 1 or 2, said correction scale means including means for determining separate weight and wind correction factors, said separate correction factors being aggregable to a single correction factor.

7. A manually operable calculator for calculating a beginning of descent position to optimize aircraft fuel consumption during descent from an actual altitude and distance to a target altitude and distance, comprising:

a first member having a distance scale displayed thereon, a plurality of additional members, each of said additional members being alignable with said first member, and having respective altitude scales displayed thereon extending over substantially equal altitude ranges, each of said altitude scales being proportioned in terms of indicated air speed below respective predetermined altitudes to correspond to respective predetermined aircraft speeds, said distance and each of said altitude scales being respectively proportioned so that, when a target distance on the distance scale is aligned with a target altitude on a respective altitude scale, the actual altitude on said respective altitude scale is aligned with a desired fuel efficient distance on the distance scale for commencing the descent, and means mutually securing said first and additional members for relative aligned movement.

8. The calculator of claim 7, wherein each of said altitude scales are proportioned to correspond to mach speed above respective predetermined transition altitudes, and to indicated air speed below said transition altitudes.

9. The calculator of claim 8, wherein said transition altitudes correspond substantially to the altitudes above which mach speed exceeds indicated air speed, and below which indicated air speed exceeds mach speed, for each respective altitude scale.

10. The calculator of claims 7, 8, or 9, wherein said distance scale is substantially linear.

11. The calculator of claim 7, wherein each of said altitude scales extend over approximately equal altitude ranges.

12. A manually operable calculator for calculating a beginning of descent position to optimize aircraft fuel consumption during descent from an actual altitude and distance to a target altitude and distance, comprising:

a first member having a distance scale displayed thereon, display means having a plurality of altitude scales displayed thereon extending over substantially equal altitude ranges, each of said altitude scales being proportioned in terms of indicated air speed below respective predetermined altitudes to correspond to respective predetermined aircraft speeds and respectively alignable with said distance scale, each of said altitude scales extending over approximately equal altitude ranges, said distance scale and each of said altitude scales being respectively proportioned so that, when a target distance on the distance scale is aligned with a target altitude on a respective altitude scale, the actual altitude on said respective altitude scale is aligned with a desired fuel efficient distance on the distance scale for commencing the descent, and means mutually securing said first member and said display means for relative aligned movement.

13. The calculator of claim 12, said display means comprising a plurality of members, each of said members having a respective altitude scale displayed thereon, and secured for relative aligned movement with respect to said first member.

14. The calculator of claim 7 or 12, further comprising an aircraft weight and wind correction scale means, said correction scale means providing a correction factor to adjust the indicated distance for commencing a descent based upon the aircraft weight and prevailing wind conditions.

* * * * *